US011179626B2

(12) United States Patent
Logan

(10) Patent No.: US 11,179,626 B2
(45) Date of Patent: Nov. 23, 2021

(54) GAME WITH USER CONFIGURABLE BOARD AND METHOD

(71) Applicant: Andy Logan, Agoura Hills, CA (US)

(72) Inventor: Andy Logan, Agoura Hills, CA (US)

( * ) Notice: Subject to any disclaimer, the term of this patent is extended or adjusted under 35 U.S.C. 154(b) by 0 days.

(21) Appl. No.: 16/777,663

(22) Filed: Jan. 30, 2020

(65) Prior Publication Data

US 2020/0238162 A1 Jul. 30, 2020

Related U.S. Application Data

(60) Provisional application No. 62/798,935, filed on Jan. 30, 2019.

(51) Int. Cl.
*A63F 3/00* (2006.01)

(52) U.S. Cl.
CPC ..... *A63F 3/00261* (2013.01); *A63F 3/0023* (2013.01); *A63F 3/00148* (2013.01); *A63F 3/00214* (2013.01); *A63F 3/00697* (2013.01); *A63F 3/00895* (2013.01); *A63F 2003/00233* (2013.01); *A63F 2003/00362* (2013.01)

(58) Field of Classification Search
CPC ..... A63F 3/00261; A63F 3/00148; A63F 3/0023; A63F 3/00697; A63F 3/00895; A63F 3/00214; A63F 2003/00362; A63F 2003/00233; A63F 3/00006; A63F 3/00; A63F 2003/00406; G09B 19/22; G09B 17/00
See application file for complete search history.

(56) References Cited

U.S. PATENT DOCUMENTS

| | | | | | |
|---|---|---|---|---|---|
| 4,569,527 | A * | 2/1986 | Rosenwinkel | A63F 3/00145 | 273/251 |
| 5,293,706 | A * | 3/1994 | Wood | G09F 1/06 | 40/124.08 |
| 5,864,973 | A * | 2/1999 | Cole | B42D 15/042 | 40/124.09 |
| 6,098,325 | A * | 8/2000 | Goldman | G09F 11/23 | 281/15.1 |
| 6,663,456 | B2 * | 12/2003 | Gemma, Jr. | A63H 3/08 | 446/147 |
| 2006/0033273 | A1 * | 2/2006 | Borne | A63F 3/00 | 273/243 |
| 2010/0311301 | A1 * | 12/2010 | Park | A63H 33/38 | 446/148 |
| 2012/0064796 | A1 * | 3/2012 | Manrique | A63J 19/00 | 446/82 |
| 2014/0120504 | A1 * | 5/2014 | Lam | G09B 5/062 | 434/178 |

* cited by examiner

*Primary Examiner* — Michael D Dennis
(74) *Attorney, Agent, or Firm* — Donn K. Harms

(57) ABSTRACT

A game kit having a game board assembled from a plurality of individual tiles is provided. The tiles each have a collapsed position and open to reveal a three-dimensional depiction of an object or location. The tiles are configurable for a plurality of different games by changing game indicia thereon. Players visit the different locations on the assembled game board and look for clues to accomplish tasks toward ending the game by accomplishing one final goal. A storyteller may serve as the director of game play for the players.

7 Claims, 10 Drawing Sheets

PROGRESS CHART

Room 1:
Task 1 ____
Task 2 ____
Task 3 ____
Task 4 ____

Room 2:
Task 1 ____
Task 2 ____
Task 3 ____
Task 4 ____

Room 3:
Task 1 ____
Task 2 ____
Task 3 ____
Task 4 ____

____ Endgame Time

38

2 | Episode Setup

READ TO YOURSELF

ROOMS REQUIRED:

Peculiar Parlour · Private Library · Mysterious Laboratory

EPISODE CHARACTERS REQUIRED:

Ghost Bride · Bee Monster · Wicked Witch Midnight

SHIVERS CHARACTERS AVAILABLE:

All Shivers family members can be used

Setup

1. The Storyteller ONLY should read through this Episode Guide
2. When ready to begin this episode, place the Parlour open on the game table
3. Place the game's box top upright in front of the Parlour
4. Place all the Episode Characters in their stands behind the Parlour wall
5. Keep the Laboratory and Library pieces nearby until ready to use
6. Check that the Story Cards for all 3 rooms are rotated to Episode #0 position
7. Put all Shivers family characters in stands, and place in front of the standing box top, along with all Character Cards, magnifying glass, and dry-erase marker.
8. Put the dice behind the Parlour wall, along with this Episode Guide
9. You're ready to begin! Ask players to select their Character figures and cards, and place the unused ones back in the game box.
10. Read the Player Rules to any new players.
11. Read the INTODUCTION section in this guide to the players and begin the game.

40

FIG. 9

3 Episode Introduction

READ ALOUD TO PLAYERS

One day, while you and the rest of the Shivers family are relaxing at home, you hear a knock on the front door. Upon opening it you find a beautiful bouquet of red roses at the doorstep.

Taking it inside, you notice a note nestled inside the fragrant bouquet. Upon inspection the note reads:

"Follow the Bee...and Hurry!" signed by someone named Penelope.

You notice a little bee buzzing happily amongst the blooms as it emerges from the flowers and starts buzzing around the room.

The bee buzzes out of an open window and, sensing an adventure, you all follow it outside the house. Down the sidewalk the bee flies, down the street towards the old spooky house on the hill called Mirador Manor!

You all gather in front of the houseas you notice the little bee buzz through the outer gate and up to the mainentrance doorway.

You look at eachother with a mix of fear and curiousity as the bee disappears through a small crack under the front door.

The sun is setting, casting long shadows across the deserted house as you wait outside the manor gates.

What do you do?

1st player to the left goes first.

42

FIG. 10

5 Endgame

READ ALOUD WHEN PROMPTED BY STORY CARDS

After players FREAKOUT and retreat to the Parlour, they will have to come up with a plan to accomplish two goals in order to win.

The first goal will be to defeat the Bee Monster. It will be staying in the Laboratory, guarding Penelope who is still tied down on the table.

The ways to defeat the Bee Monster include:

- RESTRAINING WITH THE GIANT BEE NET
- FREEZING WITH THE FREEZE POTION
- SMOKING IT TO SLEEP WITH BEESMOKER
- BLASTING IT WITH THE WAND OF WIND

Note that any player wearing the bee keeping suit cannot be stung. Any players stung by the Bee Monster will fall down and go into a deep sleep. TheBee Antidote will awaken them.

Once the Bee Monster is defeated by any of the above methods, Penelope will fully awaken and shout to be freed from her restraints. The players will have a second goal: freeing the ghost bride.

Upon untying her, she'll say "Please take me from this horrible place!" and express an urge to leave the house.

Once the players and Penelope are outside, she'll say "Thank you so much for freeing me from that terrible house!"

She'll then ask "Did you happen to find my key? Where was it hidden?"

Once players respond, she'll say: "The fireplace! That's always the last place one looks..."

With a puff of smoke, Penelop will turn into the Witch (replace her figure with the Witch figure). Before the players can react, she seizes Penelope's key from the Players, and flies off with a cackle. THE END

44

FIG. 11

GAME WITH USER CONFIGURABLE BOARD AND METHOD

This application claims priority to U.S. Provisional Patent Application Ser. No. 62/798,935, filed on Jan. 30, 2019, which is incorporated herein in its entirety by this reference thereto.

FIELD OF THE INVENTION

The disclosed device concerns games which are played by children and adults. More particularly, it relates to an adventure or story related game which employs a game board formed of engageable game tiles yielding a user configurable game board where the clamshell style tiles fold from a planar stored configuration to a three-dimensional game portion on an upper surface of each game board tile.

BACKGROUND OF THE INVENTION

The playing of games using game boards and rules for user progression upon such game boards has been a popular mode of entertainment for decades. Games like MONOPOLY and SCRABBLE and the like conventionally employ a planar game board which is imprinted with a fixed game playing surface. Users play the game by interacting with indicia upon the planar game board surface according to rules for play.

However, with the advent of computer games which are played upon video screens or using three-dimensional goggles or displays, the sale and play of conventional games using planar game boards with indicia thereon and fixed modes of play, have become much less popular. One possible reason for such is that computerized games being run by software adapting play of the computer game to actions by users interfacing with a display, provide variables in the play of the game. Such are not provided with conventional planar game boards with fixed indicia thereon.

As disclosed herein, the game kit and method of game play are enhanced through the provision of a user configurable game board using individual game board tiles which allow for varied configurations of the game board and play thereon. The game board is formed by the user for each new game using removably engaged tiles and a game board map for the intended game. The tiles feature a clamshell configuration having a planar stored position for each of the tiles.

The folded game board tiles in a folded configuration are planar and reveal nothing about the three-dimensional room or location within. The game board tiles unfold to a three-dimensional game portion which may be held in this unfolded configuration by a support member, a biasing means in the tile, or other means to maintain the two folding sides of the clamshell tile open and substantially perpendicular to each other. The game herein, thus, provides the players with many more options than are available with conventional planar boards with fixed indicia thereon, or assembled boards lacking collapsible three-dimensional object depictions and game components thereon.

The forgoing examples of games played with game boards and issues regarding such are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The device herein provides an adventure or story telling game for a group of players to play and experience an adventure or mystery or the like. The game employs a game board formed of individual game tiles allowing customized assembly of the game board to match the story or mystery episode of the game. These game tiles are removably engageable to form the game board using a map provided in the game kit for each game. The game tiles are, thus, employable for a plurality of different games depending on game indicia located on a game card and the orientation of the game card when inserted into a tile.

By engaging the removably engageable connectors on side edges of adjacent game board tiles, a game board can be assembled which includes all the rooms and locations which match the game board map correlating to the respective game or story episode of the game to be played. Additionally, the ability to assemble game board sections allows users to change the flow of the game, the steps in the game, or other aspects about the game.

In a particularly favored mode of the game, which keeps future rooms and locations hidden until players arrive at that particular game tile, the game board is assembled, but the tiles remain in their folded position until players reach a point in the game where the location on the game board tile is required whereupon it is unfolded. This significantly enhances the mystery and unpredictability of the game since players cannot view or otherwise inspect locations on the board where they may land in the future.

Each of the game tiles in the game kit, have a first panel adapted for positioning on a support surface which is hinged or rotationally engaged to a second panel. The second panel, when folded away from the first panel, is configured with a deployable three-dimensional object depiction of a room or location of one of the episodes in the story told by the game. The game tiles are movable between a stored configuration with the two panels adjacent and in contact with each other, to a deployed position wherein the second panel of the game tile is substantially perpendicular to the first panel. By providing game tiles with three-dimensional object depictions of rooms or location depictions, the players are provided with three-dimensional object depictions of structures in the room or location. This provides the players with the ability to look under and inside the three-dimensional object depictions of structures for clues and the like. For example, in a depicted bedroom, they may look under beds and furniture for clues and look behind or within picture frames on shelves and the like for other clues and instructions.

In moving the game tile on the assembled game board to the deployed position, three-dimensional game parts engaged with the two panels are concurrently moved from a hidden and planar positioning to a projecting three-dimensional object positioning. A support member is provided to hold the two panel tile in the open or deployed position. One or a plurality of the game board tiles may have wheel or variable oriented game card which is located in a cavity of the upright second panel of the tile. A window on the rear of the tile reveals portions of the game card indicia for the chosen game located on the game card or game wheel once it is inserted into the cavity.

In this fashion, orienting and insertion of a game card or rotating a game card wheel will position new rules or instructions, clues or other indicia or the like, within the window which correlates to the game chosen to be played. Such other indicia can either be shown via windows in the card panel or hidden via folding or rotating panel portions that are revealed when opened.

The game kit herein employs a game board which is configured by a storyteller user, using a provided game board map, which is configured in the engagement of the tiles to each other, to correlate to individual episodes of a story or adventure in which the players all participate. It is especially well adapted in one preferred mode for play by children, through the provision of a storyteller who leads the players through the game story episode. This storyteller also assembles game board tiles to the correct configuration and tracks the players progress through the game.

The tiles themselves are configured to be employed in any of a plurality of different games or story episodes. This is enabled through the provision of a game card which is insertable, in a plurality of orientations, into a cavity in the game tile, to change the information viewable through an opening on a back surface of the fold up panel of each game tile.

Employing the game kit herein, the story teller will sit behind the upright deployed tiles of the game board where the storyteller can open the game tiles in a timely fashion and read or insert the appropriate story cards into the respective cavities in the game tiles in the correct orientation, so that they display the current story indicia and game clues and other information, in one or more locations on the game tile rear surface.

The players will assume the role of being members of a family, currently the "Shivers" family. They will play cooperatively through the storytelling game to seek clues and game instructions in the different room and tile locations visited on the game board. Each story may have episodes, and the players will be guided by instructions from the storyteller and will move along the game board, which will have rooms or locations correlating to the story.

The players will first choose one player to be the storyteller. The storyteller will act as a guide during game play.

The players next will choose to assume a character from the Shivers family and use a marker for that character as their marker on the game board. Each character, in the family of characters, has a personality and character traits which will be given to the player on a character card. The player will read the character card matching their chosen character and then emulate those traits during the game as a member of the family.

The storyteller will read the storyteller instructions and episode guide for a chosen game from the plurality, review the game board map, and then choose the appropriate game tiles for assembly. The storyteller will then assemble the game board from the plurality of game tiles using the game board map correlating to the game or episode to be played. The storyteller will only unfold a first game tile for the room or location where the game will start and will leave the other game tiles in the assembled board folded, so their content is kept secret.

The players will take turns during which they will attempt to accomplish "actions" in the room or location depicted in the game tile on which they are positioned. By actions is meant search for clues or objects with the tile in open position, looking under and behind the three-dimensional objects depicted in the room. They will first move their game marker to the first room which is opened to display the contents thereof.

Once all the players have moved their game markers into the first room, the storyteller will read an episode introduction to the players which is the game from the plurality of games in the game kit which they will be playing and for which the tiles in the game board are configured. The storyteller will also give all the players any game information or clues which are in the opening or clue window positioned on the back side of the first room when unfolded. As noted, the game card has multiple orientations to change the clues or game information indicia positioned in the opening.

A first player, which is the first player on the left of the storyteller when facing all of the players, will go first, and can perform one action. An action is anything that takes about five seconds of activity (i.e., open the West Door, or throw the rock at the skeleton, look under bed, look in wall slot, look under the piano, look behind a three-dimensional object depiction, for clue).

Each of the players will follow, consecutively, and perform actions in the room in which they are situated.

The storyteller will track the players progress using a progress chart, which lists the tasks which must be accomplished in each room before moving to the next. The storyteller will match the actions taken by the players to the tasks on the task sheet included in the game kit and determine when the player has taken actions matching required tasks and, therefor, may progress to the next game tile. In a group setting, the actions of all of the players are employed to determine if such have matched the required tasks.

The storyteller will not unfold the next room on the game board until the players have been determined to have completed the tasks in the previous room. For every new room in which the players enter the storyteller will read the clues for that room which are shown in the clue window on the back wall of the room, which are on the properly oriented game card. In each new room, each of the players will follow the same order as the last room, and they will perform actions in that room in which they are situated.

For each room the players visit, the storyteller will track the players progress, using the progress chart, which lists the tasks which must be accomplished in each room, before moving to the next. The storyteller will match the actions taken by the players to required tasks on the task sheet and determine when the player may progress to the next game tile.

In this fashion, the players, as a group, can solve mysteries and participate as a member of the family as part of the story being told.

Once the players have moved through a number of rooms and reached an end point on the progress chart, the storyteller will direct the players to start the end game. This is because the tasks accomplished during play are calculated to directly provide clues or information to the players, enabling players to ascertain and accomplish a new task or tasks. During the end game, one or more specific tasks will be assigned to the players to accomplish. This task will be related to the episode of the game they are playing, and the tasks that the players accomplished, such as vanquishing a foe, or solving one final puzzle. The players will work as a group to arrive at the solution to this final end game.

Upon completion of the end game portion, the game is over and the room panels may be stowed with the other game parts, or a new episode may be played.

With respect to the above description, before explaining at least one preferred embodiment of the herein disclosed game having a removably assembled board with three-dimensional game portions invention in detail, it is to be understood that the invention is not limited in its application to the details of construction and to the arrangement of the components in the following description or illustrated in the drawings. The invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other games having game boards, which are variable according to user-chosen assembly and having three-dimensional object depicting game portions thereon, and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The term "substantially" when employed herein, means plus or minus twenty percent unless otherwise designated in range.

It is an object of the present invention to provide a game kit and game for children or adults which employs a variable game board configuration which is determined by user assembly prior to game play.

It is an additional object of this invention to provide such a game kit having a game board which is formed of folding tiles having removably engageable connecters on side edges, such as magnets, to provide easy variable board engagements and configurations chosen by a user.

It is a further object of the invention to provide such tiles for assembly to a game board which, when opened, form a folded configuration, have pop-up three-dimensional rooms and figures and other components of the game thereon, to provide three-dimensional places for finding hidden clues and such.

It is yet another object of this invention, to provide such a game kit which employs pop-up three-dimensional object depicting displays of rooms and objects and the like, each of which is employable for a plurality of different games through a change in orientation of a game card which is inserted into the game tile.

These and other objects, features, and advantages of the present game kit system having a user assembled variable game board, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed game system and method. It is intended that the embodiments and figures disclosed herein are to be considered illustrative of the invention herein, rather than limiting in any fashion.

Figure 1:
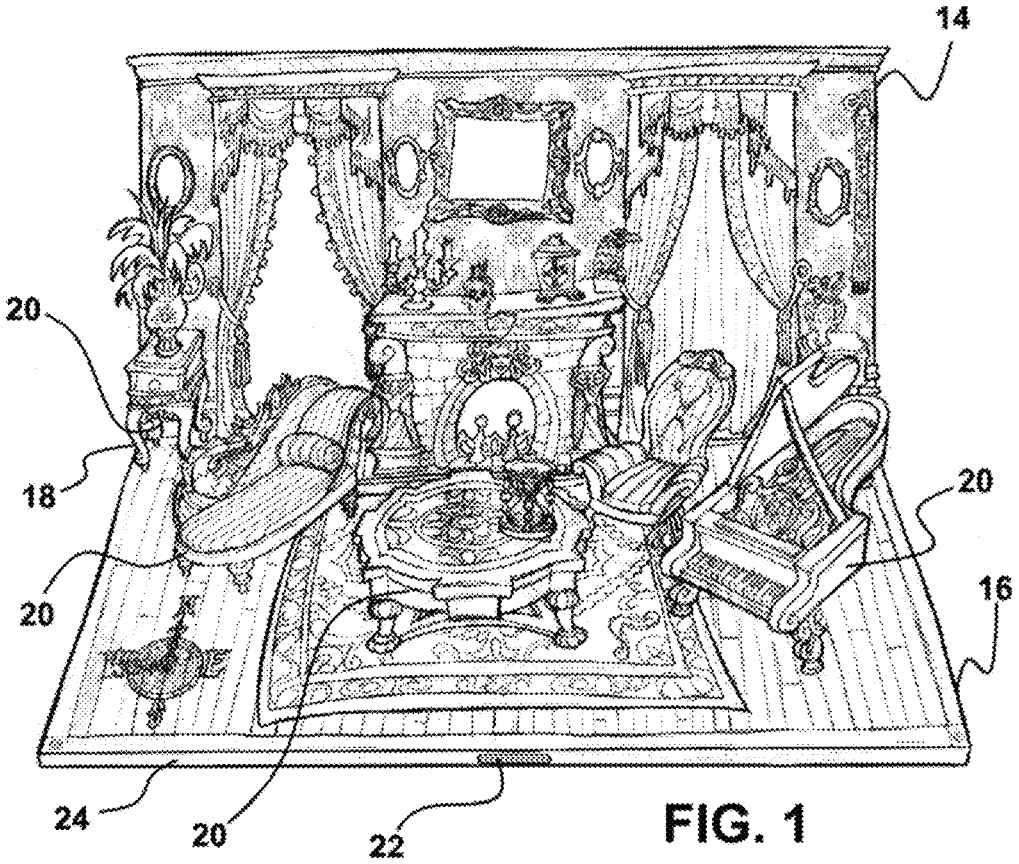
FIG. 1 depicts a typical game board tile for the game kit herein having a clamshell configuration of two folding sides which move from the stored position shown in FIG. 2 to a deployed position with three dimensional object depictions as in FIGS. 1, 3-4.
Figure 3:
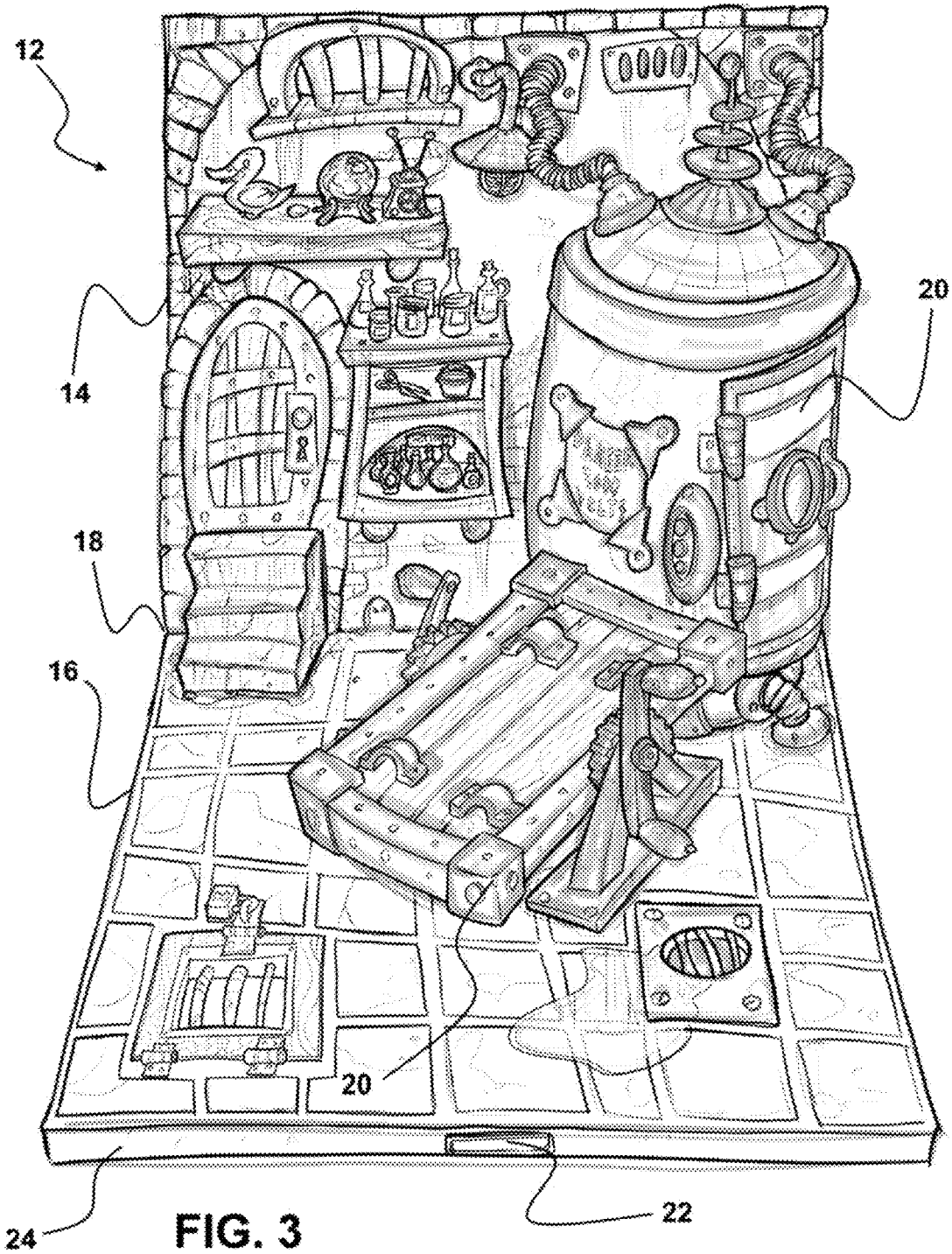
FIG. 3 shows another example of an unfolded three dimensional game board tiles herein having three dimensional object depictions thereon.
Figure 4:
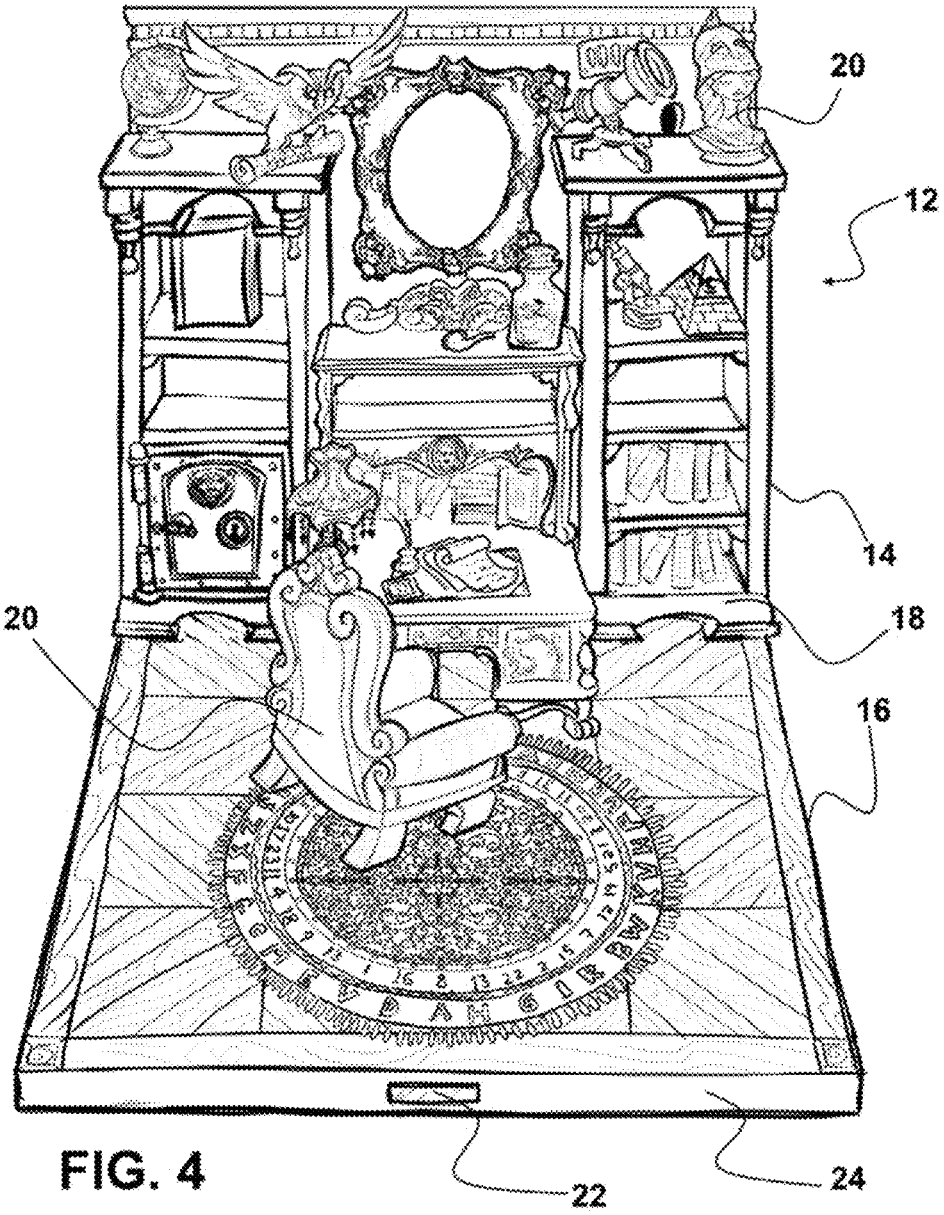
FIG. 4 shows another example of an unfolded three dimensional game board tile herein.
Figure 5:
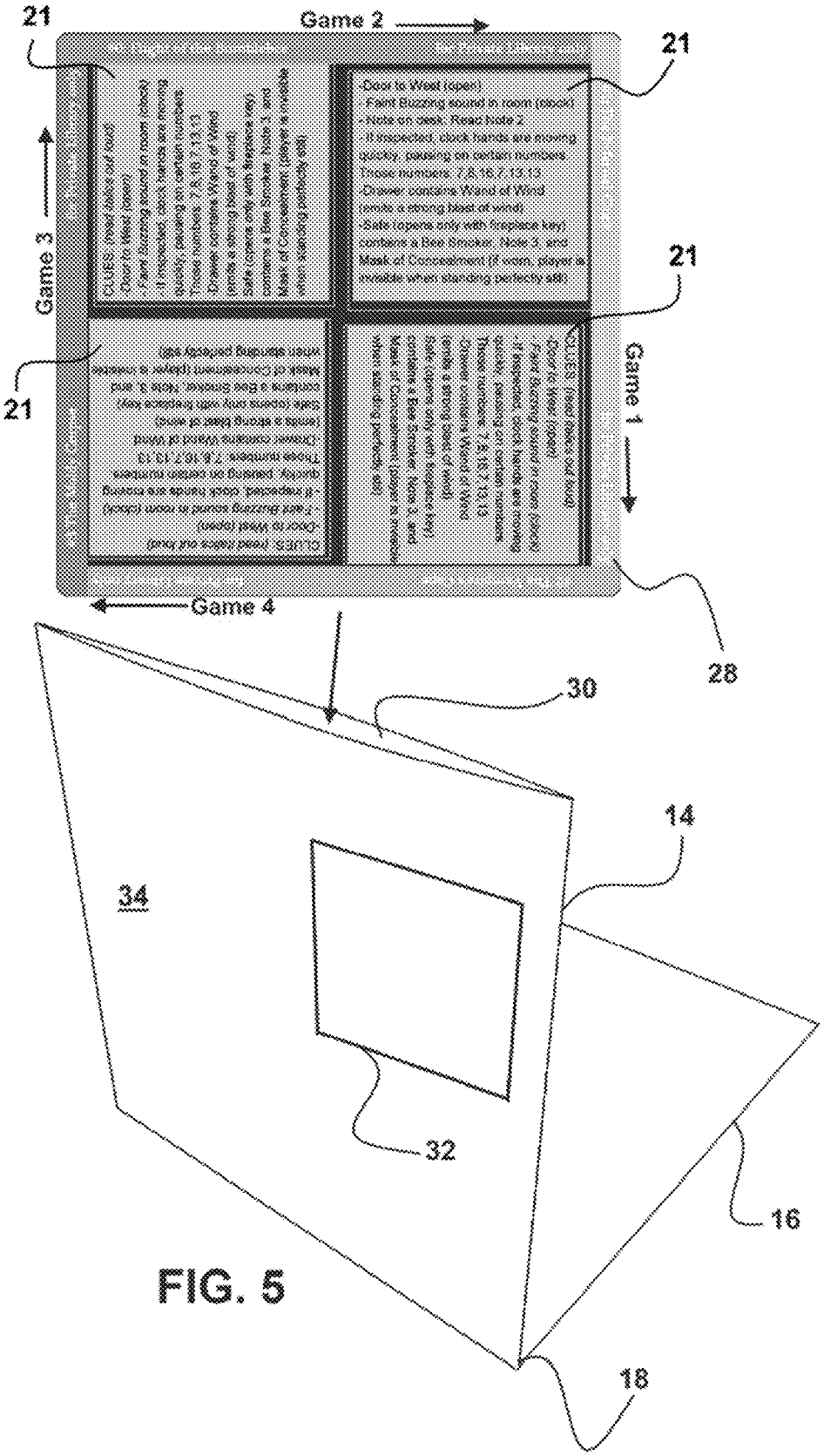

FIG. 5 shows a rear surface of one of the two folding sides of the game board tiles as in FIGS. 1, 3-4 showing a game card having multiple orientation correlating to multiple games which, once inserted into the rear wall cavity, will position game play indicia, for the room or location represented on the tile three dimensional depiction, for an individual game, from the plurality on the game card, into view in a window opening.

Figure 6:
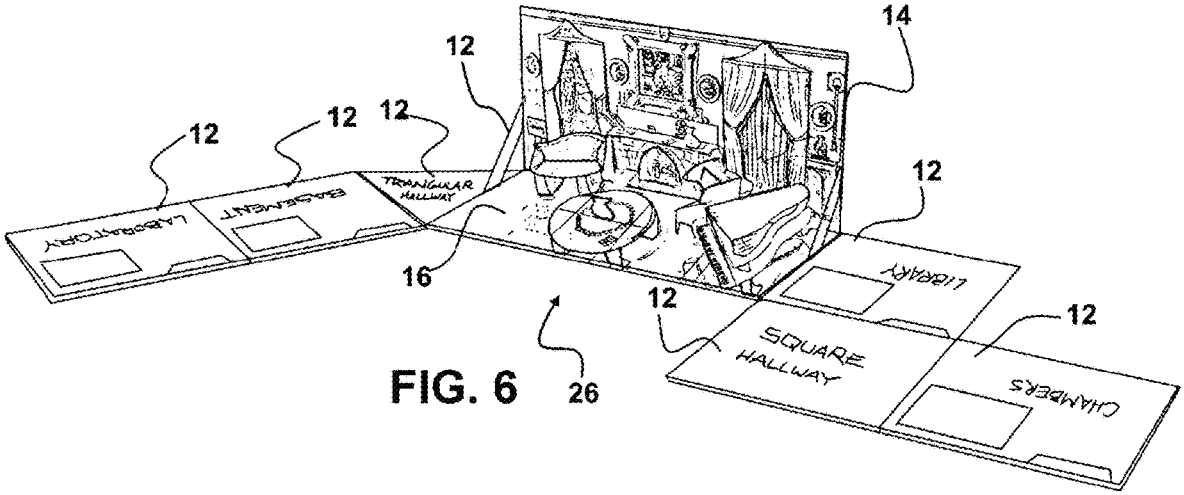

FIG. 6 shows a game board set up for use by the storyteller in assembling a game board for a chosen game, from individual tiles.

Figure 6A:
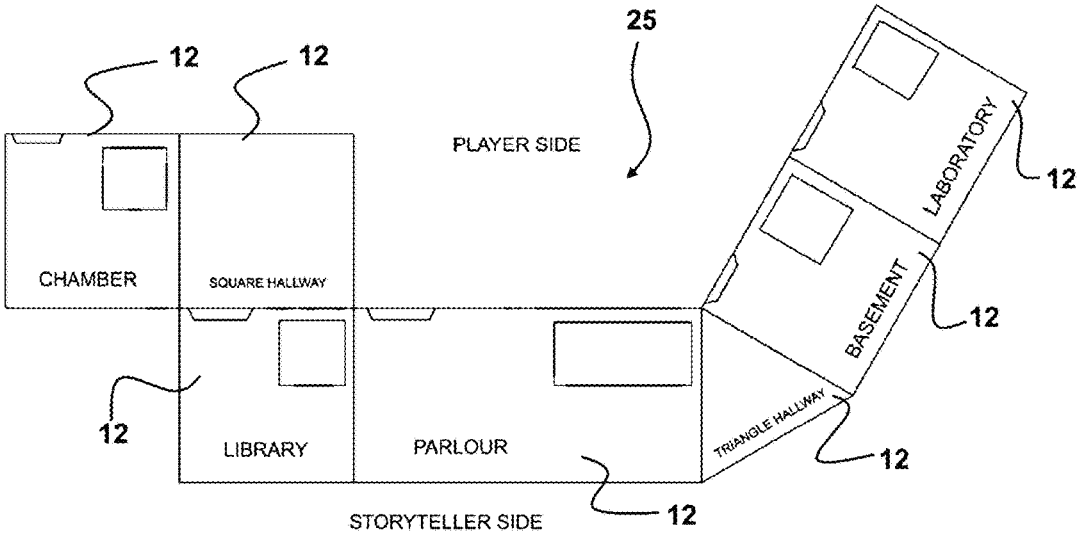

FIG. 6A depicts an individual game board map provided in the game kit for each game or game episode to the storyteller to assemble the game board such as in FIG. 6.

Figures 7, 8:
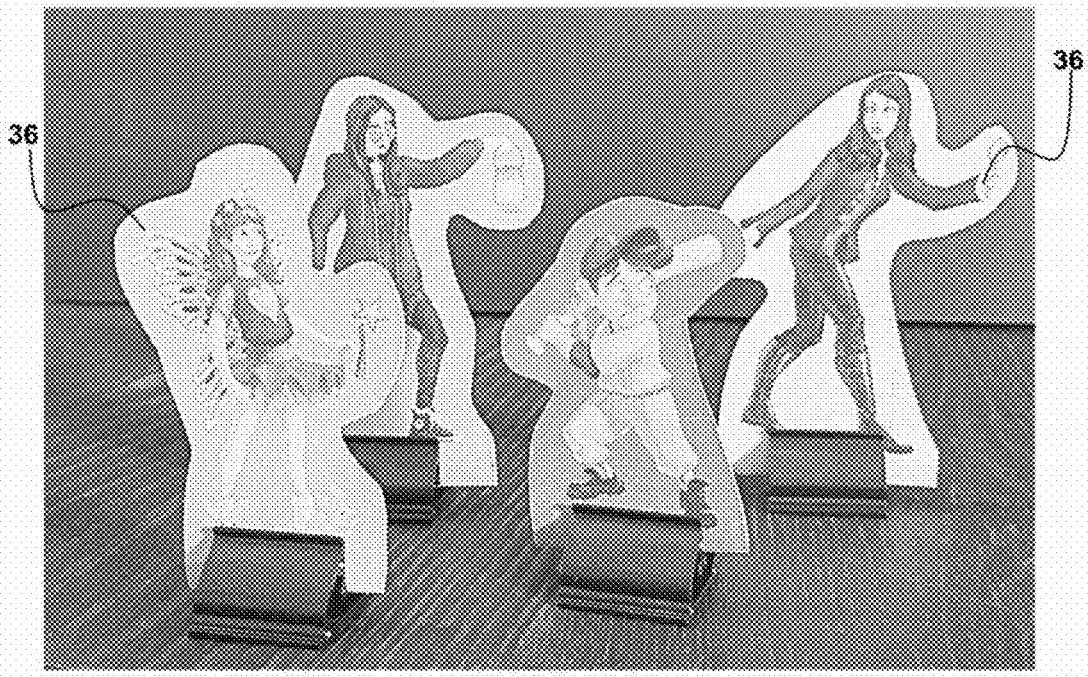

FIG. 7 depicts a plurality of characters for choosing by players as their game marker.

FIG. 8 depicts an example of a progress chart provided in the game kit and employed by the storyteller to direct game play by the players.

FIG. 9 shows an episode setup instruction card in the game kit which is employed by the storyteller to set up an individual game episode for the players, from the plurality in the game kit.

FIG. 10 is an example of an episode introduction in the game kit, which the storyteller reads to the players which correlates to an individual episode of the game to be played.

FIG. 11 shows an example of end game instructions from the game kit, which the storyteller reads to the players to communicate one or a plurality of tasks to accomplish to finish the individual game being played.

DETAILED DESCRIPTION OF THE INVENTION

In this description, the directional prepositions of up, upwardly, down, downwardly, front, back, top, upper, bottom, lower, left, right and other such terms refer to the device as it is oriented and appears in the drawings and are used for convenience only and such are not intended to be limiting or to imply that the device has to be used or positioned in any particular orientation.

Now referring to drawings in FIGS. 1-11, wherein similar components are identified by like reference numerals, there is seen in FIG. 1 a typical game board tile 12 provided in the game kit herein to enable the method of play herein. The game tiles 12 have a clamshell configuration having a first side panel 14 in a folding or pivoting engagement 18 with a second side panel 16. The tiles shown in FIGS. 1 and 3-4, as with all tiles 12 employed in the game herein, have a folded or collapsed position shown in FIG. 2. In this collapsed position, the three dimensional object depictions 20 are also collapsed and hidden in-between the adjacent first side panel 14 and second side panel 16. By the term, three dimensional object depictions 20, is meant, that three dimensional objects are formed in a pop-up, by the unfolding of a tile 12, such as furniture, paintings, wall fixtures, rugs, shelves, tables, chairs, windows, openings, openable doors, vehicles, passages, lamps, home furniture, books, and the like. This listings is not intended to be limiting, and any furniture or object which would occur to those skilled in the art and can be formed in a pop-up configuration, is intended within this definition. Further, while this application focuses on using folding tiles 12 which open so show three dimensional objects 20, it is envisioned that at least one tile 12 may be employed as a first tile in the game, which does not fold, but does have a three dimensional object 20 thereon, which will collapse.

Figure 2:
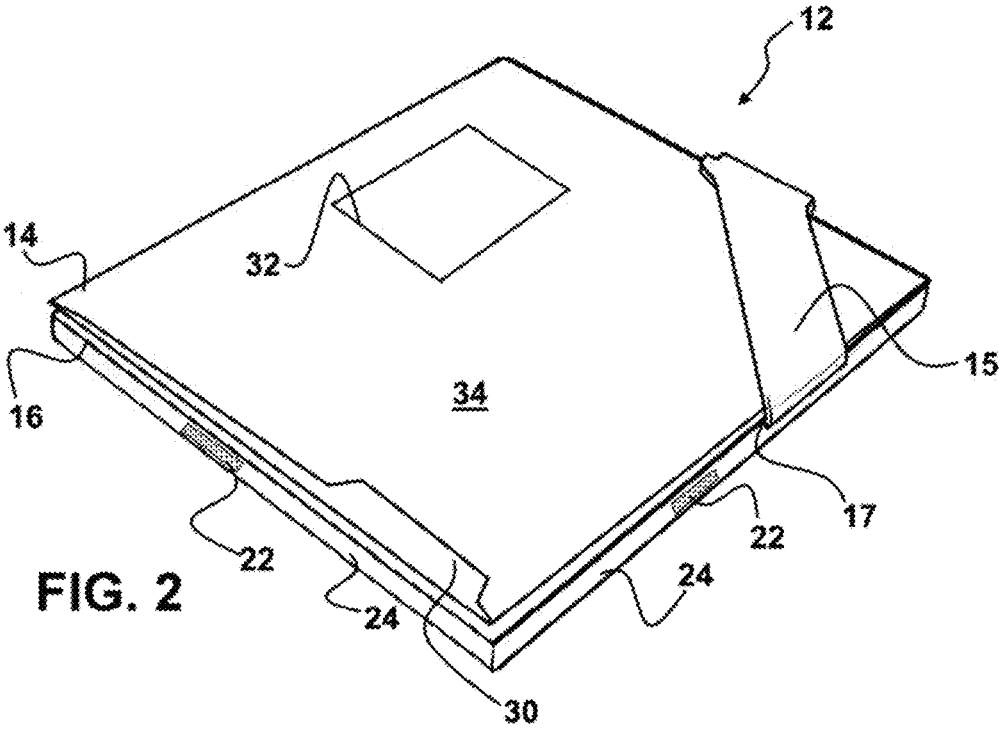
FIG. 2 shows the folding game board tile of FIG. 1 in a folded position held by the support member and hiding the three dimensional depictions therein.
Figure 2A:
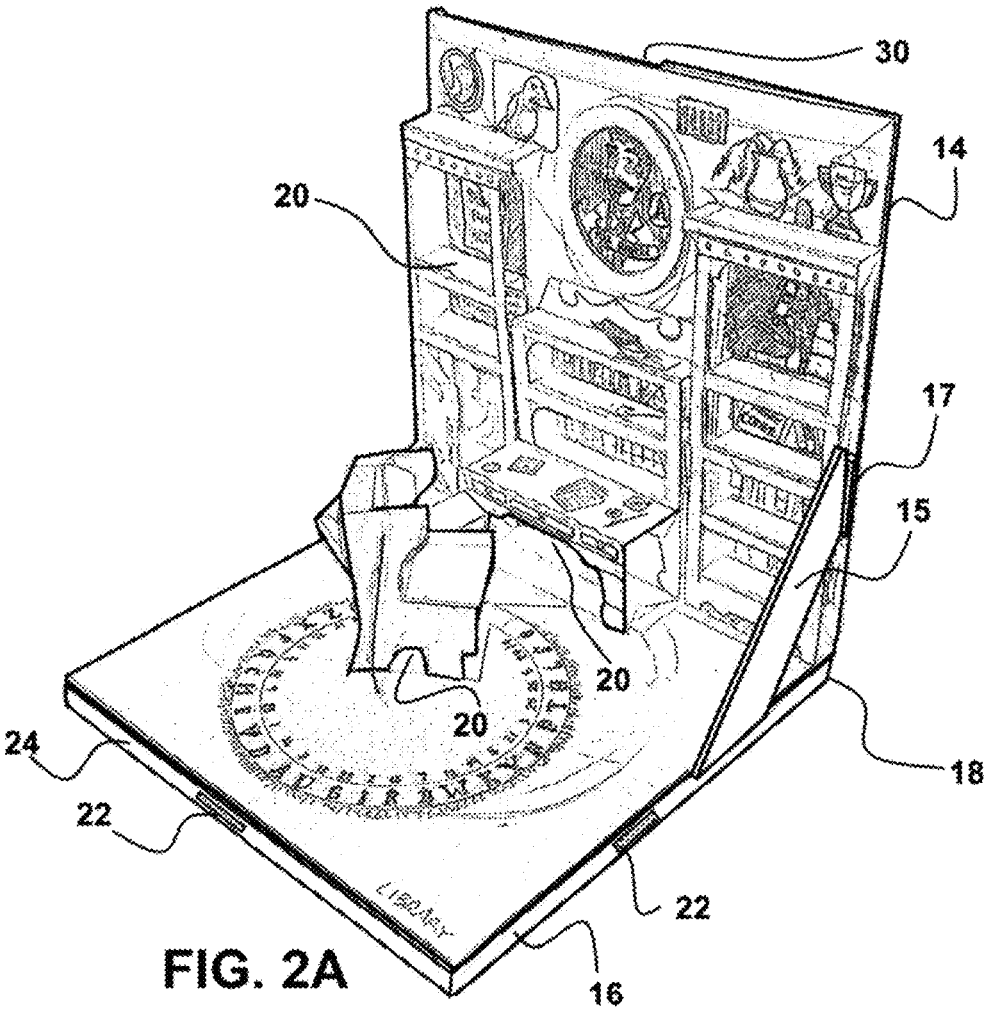
FIG. 2A shows a game tile held in the open or deployed position by a support member.

As shown in FIGS. 2 and 2A, each tile will preferably have a support member 15. The support member 15 as shown in FIG. 2 is engaged to one of the first folding panel 14 or the second folding panel 16. With the tile 12 in the collapsed position of FIG. 2, the support member 15 may be employed to hold the tile 12 in the collapsed position when it is being stored, or before the storyteller opens it during a game. Where used to hold the tile 12 in the collapsed position, a releasable connector 17, such as hook and loop fabric, magnets, or a post and socket engagement, or the like, will be included, to secure the distal end of the support member 15 in place. As shown in FIG. 2A, this support member 15 is removably positionable in contact between the first side panel 14 and second side panel 16, to hold the tile 12 in the open or deployed position of FIG. 2A. While not shown in some of the depictions of tiles 12 herein, the support member 15 is preferred for inclusion in all modes of the game herein to provide ease of use to both deploy and hold the tiles 12 in their two states.

As shown in FIGS. 1, 3-4, when in a deployed configuration, the tiles 12 have three-dimensional objects 20 thereon. The provision of such three-dimensional objects 20 provides the players with many hiding places to search during the game, to find clues and instructions to move forward. While a three-dimensional chair and piano and boiler and the like are shown, this should not be limiting and any three-dimensional object that may be depicted relating to a story being told may be used.

Each of the tiles 12 has one or a plurality of releasable fasteners 22 located in positions on a sidewall 24 of the second side panel 18. These releasable fasteners 22 are employed to connect the individual tiles 12 to form a game board 26 such as shown in FIG. 6. Thus, the tiles 12 can be assembled in an infinite number of configurations to accommodate different game episodes.

Shown in FIG. 5, is a depiction of a game card 28 which has game play indicia 21 thereon such as instructions, hints, and clues. As shown, the game card 28 has such game play indicia 21 for a plurality of different respective games thereon in different positions and orientations on the game card 28. The game card 28 is rotatable in orientation, prior to insertion into a cavity 30 formed in the first side panel 14 which as shown will be the first side panel 14 which is positioned substantially perpendicular to the second side panel 16 when in the deployed or unfolded configuration and held in such a position by the support member 15.

Depending on the chosen orientation during insertion into the cavity 30, one of the plurality of different individual game play indicia 21, located on the game card 28, will align in an upright and readable position within an opening 32 in a rear surface 34 of the first side panel 14. With the game card 28 inserted into the cavity 30, in the orientation for the game to be played, this game play indicia 21 will be positioned on the tile 12 for reading and review by the storyteller, and revealing to the players at the appropriate time during game play.

The employment of this game card 28 having this plurality of orientations for insertion into the cavity 30 to display one of a plurality of different game play indicia 21 through the opening 32, allows the clues and information in the game indicia for each tile 12 to change. Thus, each tile 12, can be used for and assembled into a respective game board 26, for any of multiple and different games playable in the game kit. This is most preferred in all modes of the game kit and method of game play herein.

Shown in FIGS. 6 and 6A is an example of the set up of the game board 26 by the storyteller for a specific game, using a game board map 25. An individual game board map 25 is provided in the game kit, for each individual game for which the plurality of tiles 12 may be assembled. It is employed by the storyteller to correctly assemble a game board 26, which correlates to the story episode or game from the plurality of games for which the tiles 12 may be employed.

During setup, the storyteller will consult this game board map 25, and choose the appropriate tiles 12 to assemble the game board 26 to provide the individual locations the players will visit during the game. The tiles 12 will be positioned with their respective releasable fasteners 22 engaged to form the game board 26. Such releasable fasteners 22 may be magnets or buttons, or hook and loop fabric, or other releasable fasteners 22 as would occur to those skilled in the art. The first game tile 12 for the location on the game board 26 for the start of the game will be positioned to the open or deployed position, and the support member 15 will be engaged to hold that position.

In FIG. 7 is shown an example of a family of character markers 36 from which players will choose their character from the family correlating to a marker, for play in the game. As noted, it is intended in the game herein, that the players will try to act with the same personality and characteristics of their chosen character during the game.

As noted above, the storyteller will track the progress of the players in achieving certain tasks during game play. These tasks will differ with each game but will be listed on a progress chart 38 as tasks to be completed. The storyteller will watch the players playing the game and performing their individual actions during a turn in each room they encounter. Such actions, for example, may be looking under beds or chairs and in hiding places in the three-dimensional objects 20 to find clues or instructions, or to find loose objects which will aid in game play such as toy guns, hammers, or other loose objects. Once the storyteller determines all tasks for a room have been accomplished, the storyteller will direct the players to the tile 12 holding the next room where they will perform actions toward accomplishing tasks.

As noted, the storyteller has the task of setting up the game board 26, matching the game cards 28 to their respective cavities 30 in respective tiles 12, and to direct game play. Each tile 12 so assembled will be a different location on the game board 26 which the players will visit during a game. FIG. 9 shows an example of an episode setup task list 40 which is used by the storyteller at the outset of a game, to determine the components needed to play the game for the individual game or episode of choice.

During game play, as noted above, the storyteller will read an introduction to the players at the start of game play of each episode of the story. FIG. 10 shows an example of such an episode introduction 42. Of course the verbiage of such episode introductions 42 will vary depending on the characters and game being played. The players will then move to different locations on the game board represented by the tiles 12 thereon.

At a point in the game, where the storyteller determines from the progress chart 38 that the appropriate tasks have been accomplished by the players, the storyteller will start the play of an end game. At the start of the end game, the storyteller will read an end game explanation of one or more tasks or goals that need to be accomplished to end or win the game. FIG. 11 depicts an example of such an end game explanation 44 which, of course, will vary in wording, background, and goals, depending on the episode of the game being played.

It should be noted that any of the different depicted and described configurations and components of the removably engageable game board tiles forming the game system herein, can be employed with any other configuration or component shown and described as part of the device herein. Additionally, while the present invention has been described herein with reference to particular embodiments thereof and/or steps in the method of production or use, a latitude of modifications, various changes and substitutions are intended in the foregoing disclosure, and it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A game kit, comprising:

a plurality of individual game tiles, said plurality of individual game tiles assemblable together to form a game board;

each game tile having a first side panel pivotally engaged to a second side panel;

each said game tile having a deployed configuration with said first side panel rotated to a substantially perpendicular position relative to said second side panel;

each said game tile having a collapsed position with said first side panel folded against said second side panel;

an episode instruction card, said episode instruction card providing game players information about the game to be played on the assembled game board;

each said game tile having a different three-dimensional object depiction which is exposed while in said deployed configuration;

a game board map providing instructions for assembly of a game board using respective individual game tiles from said plurality of game tiles;

a game card, said game card having game play indicia thereon for a plurality of individual games;

said game card insertable into a cavity formed in said first side panel of each respective said game tile;

an opening in a rear surface of said first side panel, said opening communicating with said cavity;

said game card having a plurality of orientations for insertion into said cavity, each respective orientation positioning a different respective said game play indicia concerning a different game episode, for disclosure to said players, within said opening;

said game tiles in said plurality of game tiles being employable for a plurality of different individual games depending on the orientation of the game card inserted into the cavity of each said game tile; and a plurality of character markers from which to choose a respective one each by each said game players, for marking each said players positioning on said game board during play.

2. The game kit of claim 1 additionally comprising:

releasable fasteners positioned on sidewalls of said second side panel of each of said plurality of game tiles; and said releasable fasteners engaging said game tiles assembled into said game board in removable engagements to each other.

3. The game kit of claim 2 additionally comprising:

each said game tile having a support member engaged thereto; and said support member positionable to hold said game tile in said deployed configuration.

4. The game kit of claim 1 additionally comprising:

each said game tile having a support member engaged thereto; and said support member positionable to hold said game tile in said deployed configuration.

5. The game kit of claim 1, additionally comprising:

a game play instruction designating one player to act as a storyteller;

a game episode setup instruction card employed by said storyteller, said episode setup instruction card designating the game tiles required for the specific game episode to be played;

said episode setup instruction card designating to said storyteller the individual characters to include in said plurality of game characters;

an episode instruction for said storyteller to read to said game players;

a game board map for said storyteller to assemble said game board from said game tiles;

a progress chart correlating to said game episode, said progress chart itemizing tasks which must be accomplished by players during said game; and an end game instruction for reading to said players by said storyteller itemizing a task to be accomplished to end the game.

6. A game kit, comprising:

a plurality of individual game tiles, said plurality of individual game tiles assemblable to a game board;

each said game tile having a deployed configuration with a different three-dimensional object depiction which is exposed while in said deployed configuration;

each said game tile having a collapsed position with said three-dimensional object depiction collapsed;

an episode instruction card, said episode instruction card providing game players information about the game to be played on the assembled game board;

a game board map providing instructions for assembly of a game board using respective individual game tiles from said plurality of game tiles;

a game card, said game card having game play indicia thereon for a plurality of individual games;

said game card insertable into a cavity formed in a first side panel of said game tiles;

an opening in a rear surface of said first side panel, said opening communicating with said cavity;

said game card having a plurality of orientations for insertion into said cavity, each respective orientation positioning a different respective said game play indicia concerning a different game episode, for disclosure to said players, within said opening;

said game tiles in said plurality of game tiles are employable for a plurality of different individual games depending on the orientation of the game card inserted into the cavity of each said game tile; and a plurality of character markers from which to choose a respective one each by each said game players, for marking each said players positioning on said game board during play.

7. The game kit of claim 6 additionally comprising:

releasable fasteners positioned on sidewalls of said second side panel of each of said plurality of game tiles; and said releasable fasteners engaging said game tiles assembled into said game board in removable engagements to each other.

* * * * *